US008376689B2

(12) United States Patent
Bhagavatheeswaran et al.

(10) Patent No.: US 8,376,689 B2
(45) Date of Patent: Feb. 19, 2013

(54) TURBINE ENGINE SPACER

(75) Inventors: Anantha Padmanabhan Bhagavatheeswaran, Karnataka (IN); Rohit Pruthi, Karnataka (IN)

(73) Assignee: General Electric Company, Schenectady, NY (US)

( * ) Notice: Subject to any disclaimer, the term of this patent is extended or adjusted under 35 U.S.C. 154(b) by 413 days.

(21) Appl. No.: 12/759,811

(22) Filed: Apr. 14, 2010

(65) Prior Publication Data

US 2011/0255977 A1 Oct. 20, 2011

(51) Int. Cl.
*F01D 5/08* (2006.01)

(52) U.S. Cl. ..... 415/115; 415/116; 415/173.7; 416/95; 416/96 R; 416/97 R

(58) Field of Classification Search ..... 415/115–117, 415/173.7; 416/95, 96 R, 97 R, 198 A, 200 A, 416/201 R See application file for complete search history.

(56) References Cited

U.S. PATENT DOCUMENTS

| | | | | |
|---|---|---|---|---|
| 4,432,697 | A * | 2/1984 | Miura et al. | 416/198 A |
| 4,795,307 | A * | 1/1989 | Liebl | 415/115 |
| 6,558,118 | B1 * | 5/2003 | Brisson et al. | 415/173.7 |
| 7,101,144 | B2 | 9/2006 | Haje et al. | |
| 2007/0189890 | A1 * | 8/2007 | Snowsill et al. | 415/115 |

* cited by examiner

*Primary Examiner* — Christopher Verdier
(74) *Attorney, Agent, or Firm* — Cantor Colburn LLP

(57) ABSTRACT

A turbine is provided and includes a spacer having an annular body formed with opposing outward and inward surfaces and an orifice extending through the body from the outward to the inward surface, an assembly to secure the spacer around a rotor axially between sequential buckets of a forward turbine stage and an aft turbine stage, the spacer forming an annular passage around the rotor into which a fluid flows through the orifice and a circuit fluidly coupled to the annular passage to deliver the fluid from between the sequential buckets of the forward turbine stage and the aft turbine stage to an axial location forward of the forward turbine stage.

18 Claims, 1 Drawing Sheet

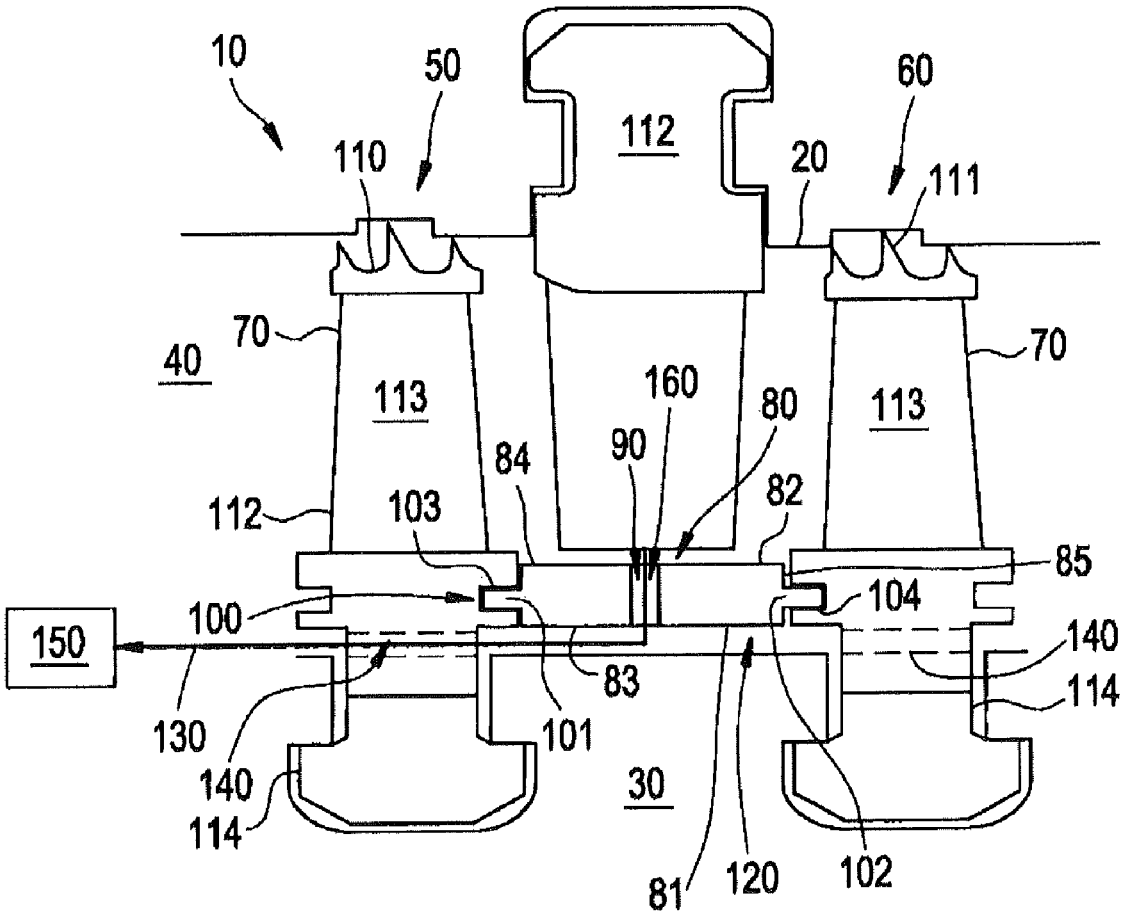
10
50
60
112
110
20
111
70
40
113
160
80
113
70
90
84
82
112
103
85
100
104
150
140
83
114
130
101
140
30
114
81
120
102

TURBINE ENGINE SPACER

BACKGROUND OF THE INVENTION

The subject matter disclosed herein relates to a turbine engine with a spacer.

In power plants, one of the factors attributed to an increase in combined cycle (CC) efficiency is the increase in inlet steam temperature. That is, a temperature increase by around 50 deg F. can lead to a considerable increase in the CC power plant efficiency. Studies have shown, however, that these increased temperatures can affect the rotor life. This is especially true if the temperatures in question are already in the materials limiting margin.

This problem has been addressed by the use of more temperature resistant rotor materials, which is a costly solution. Alternatively, a conventional cooling scheme has been previously proposed in which the few initial stages of the rotor are cooled using relatively cool steam supplied from an external source and, thus, avoiding the need to replace the entire rotor with costlier material. This cooling option can be employed for the initial few stages through which the main steam temperature drops considerably enough to be withstood by lower temperature resistant material. It is, however, relatively costly to install and complicated to design and operate.

BRIEF DESCRIPTION OF THE INVENTION

According to one aspect of the invention, a turbine is provided and includes a spacer having an annular body formed with opposing outward and inward surfaces and an orifice extending through the body from the outward to the inward surface, an assembly to secure the spacer around a rotor axially between sequential buckets of a forward turbine stage and an aft turbine stage, the spacer forming an annular passage around the rotor into which a fluid flows through the orifice and a circuit fluidly coupled to the annular passage to deliver the fluid from between the sequential buckets of the forward turbine stage and the aft turbine stage to an axial location forward of the forward turbine stage.

According to another aspect of the invention, a turbine engine is provided and includes a rotor disposed within a casing to define a passage through which fluid flows from a forward to an aft turbine stage at which the fluid is relatively cooled, a spacer having an annular body formed with opposing outward and inward surfaces and an orifice extending through the body from the outward to the inward surface, an assembly to secure the spacer around the rotor axially between sequential buckets of the forward and the aft stage, the spacer forming an annular passage around the rotor into which the cooled fluid flows through the orifice and a circuit fluidly coupled to the annular passage to deliver the cooled fluid from between the sequential buckets of the forward and the aft stage to an axial location forward of the forward stage.

According to yet another aspect of the invention, a steam turbine engine is provided and includes a rotor disposed within a casing to define a passage through which steam flows from a forward to an aft turbine stage at which the steam is relatively cooled, a spacer having an annular body formed with opposing outward and inward surfaces and an orifice extending through the body from the outward to the inward surface, an assembly to secure the spacer around the rotor axially between sequential buckets of the forward and the aft stage, the spacer forming an annular passage around the rotor into which the cooled steam flows through the orifice and a circuit fluidly coupled to the annular passage to deliver the cooled steam from between the sequential buckets of the forward and the aft stage to an axial location forward of the forward stage.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The sole FIGURE is a schematic side sectional view of a turbine.

The detailed description explains embodiments of the invention, together with advantages and features, by way of example with reference to the drawings.

DETAILED DESCRIPTION OF THE INVENTION

With reference to the FIGURE, a turbine 10, such as a steam turbine of a steam turbine engine, is provided. The turbine 10 includes a casing 20 and a rotor 30 rotatably disposed within the casing 20 to define a fluid path 40 extending at least from a forward turbine stage 50 to an aft turbine stage 60. Steam, heated gas or some other fluid (for clarity and brevity, hereinafter "steam") flows along the fluid path 40 and interacts with turbine buckets 70. The steam is generally relatively hot at the forward turbine stage 50 and relatively cool at the aft turbine stage 60.

A spacer 80 is secured within the casing 20 and has an annular body 81, which may be tubular and/or substantially cylindrical and is formed with opposing outward and inward surfaces 82 and 83 that extend axially between forward and aft ends 84 and 85. The annular body 81 is further formed with a tunability orifice (hereinafter "orifice") 90 extending through the body from the outward surface 82 to the inward surface 83. The orifice 90 may be oriented in a substantially radial direction and may be plural in number. That is, the spacer 80 may have plural orifices 90 that are each circumferentially discrete and arrayed circumferentially around the rotor 30.

An assembly 100 secures the spacer 80 around the rotor 30 at an axial location between the forward turbine stage 50 and the aft turbine stage 60 such that the spacer 80 is positioned between sequential turbine buckets 110 and 111 with the orifice 90 opposing a turbine nozzle 112. The spacer 80 forms an annular passage 120 around the rotor 30 which is defined between inward surface 83 and the surface of the rotor 30. The steam flowing along the fluid path 40 toward the aft turbine stage 60 may at least partially flow into the annular passage 120.

The sequential turbine buckets 110 and 111 are among a plurality of like turbine buckets arrayed circumferentially around the rotor 30 at multiple turbine stages and are disposed to rotate about a longitudinal axis of the rotor 30 as the steam flows along the flow path 40. The sequential turbine buckets 110 and 111 may each include a blade section 113, over which the steam flows, and a fir-tree section 114, which is insertable into a corresponding dovetail section of the rotor 30.

In accordance with embodiments, the assembly 100 may include mating flanges 101 and 102, which are disposed at the forward and aft sides of the spacer, and which are receivable in mating grooves 103 and 104 of aft and forward sides of the sequential turbine buckets 110 and 111. The mating flanges 101 and 102 extend axially from the ends 84 and 85 of the spacer 80 and the mating grooves 103 and 104 are defined in opposing sides of the sequential turbine buckets 110 and 111. In some cases, the mating flanges 101 and 102 may extend from mid-sections of the opposing spacer ends 84 and 85.

A circuit 130 is fluidly coupled to the annular passage 120 and receptive of the steam that flows therein. The circuit 130 is further configured to deliver the steam from an axial location between the forward turbine stage 50 and the aft turbine stage 60 to an axial location that is at least forward of the forward turbine stage 50 where it is employed for cooling. The circuit 130 may be defined along various routes and through multiple features and generally skims along a surface of the rotor 30 while being insulated from the relatively hot steam flowing along the flow path 40.

An amount of the steam that flows into the annular passage 120 may be maintained within a predefined range. This range may be at least sufficient to ensure that enough steam is available to maintain operational conditions downstream from the aft turbine stage 60 and no more than necessary to provide a desired cooling effect at the forward turbine stage 50.

The circuit 130 may be defined through a gun hole 140 formed within at least the more forward sequential turbine bucket 110 and, in particular, within the fir-tree section 114 thereof. The gun hole 140 may be oriented in a longitudinal direction that is generally in line with the rotor 130. Additional spacers at other turbine stages may be employed to insulate the cooled steam flowing along the circuit 130. These additional spacers form additional annular passages through which the circuit 130 may extend. The gun hole 140 may be circumferentially discrete and provided as part of a plurality of gun holes 140 that are arrayed circumferentially about the rotor 30. Each of the plurality of gun holes 140 may be fluidly coupled to the annular passage 120 and the additional annular passages.

The circuit 130 may be configured to deliver the steam to, for example, a packing head region 150 or any region disposed forward of the forward turbine stage 50 that has a pressure that is lower than that of the axial location between the forward turbine stage 50 and the aft turbine stage 60 (i.e., an extraction region defined around the spacer 80). In particular, the steam may be delivered to a surface of a turbine bucket. In any case, the cooled steam may be employed to effectively reduce temperatures forward of the forward stage 50 such that more highly heated steam can be permitted to enter the flow path 40 without risking excessive damage.

The turbine 10 may further include a spacer plug 160, which may be employed to selectively close the orifice 90. In this way, the amount of steam permitted to enter the annular passage 120 can be increased, decreased, maximized or cut off completely.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine, comprising:

a spacer having an annular body formed with opposing outward and inward surfaces and an orifice extending through the body from the outward to the inward surface;

an assembly to secure the spacer around a rotor axially between sequential buckets of a forward turbine stage and an aft turbine stage, the spacer forming an annular passage around the rotor into which a fluid flows through the orifice; and a circuit defined through a gun hole formed within a fir-tree section of the more forward one of the sequential buckets, the circuit being fluidly coupled to the annular passage to deliver the fluid from between the sequential buckets of the forward turbine stage and the aft turbine stage to an axial location forward of the forward turbine stage.

2. The turbine according to claim 1, wherein the annular body of the spacer is tubular.

3. The turbine according to claim 1, wherein the orifice is oriented in a substantially radial direction with respect to the rotor.

4. The turbine according to claim 1, wherein the orifice is circumferentially discrete.

5. The turbine according to claim 1, wherein the orifice is plural, the plurality of orifices being arrayed circumferentially around the rotor.

6. The turbine according to claim 1, wherein the orifice is located at an axial location corresponding to that of a turbine nozzle.

7. The turbine according to claim 1, wherein the assembly comprises mating flanges at the forward and aft sides of the spacer, which are receivable in mating grooves of aft and forward sides of the sequential buckets.

8. The turbine according to claim 7, wherein the mating flanges extend axially from opposing ends of the spacer and the mating grooves are defined in opposing sides of the sequential buckets.

9. The turbine according to claim 8, wherein the mating flanges extend from mid-sections of the opposing spacer ends.

10. The turbine according to claim 1, wherein the fluid comprises steam directed to flow through an outer annular passage from the forward turbine stage to the aft turbine stage.

11. The turbine according to claim 10, wherein the steam is relatively cool compared to a temperature thereof in the outer annular passage at the forward turbine stage.

12. The turbine according to claim 1, wherein the gun hole is circumferentially discrete.

13. The turbine according to claim 1, wherein the gun hole is plural, the plurality of gun holes being arrayed circumferentially around the rotor.

14. The turbine according to claim 13, wherein the circuit is further defined through an annular passage forward from the gun hole.

15. The turbine according to claim 1, wherein the circuit is configured to deliver the fluid to a packing head region.

16. The turbine according to claim 1, further comprising a spacer plug to selectively close the orifice.

17. A turbine engine, comprising:

a rotor disposed within a casing to define a passage through which fluid flows from a forward to an aft turbine stage at which the fluid is relatively cooled;

a spacer having an annular body formed with opposing outward and inward surfaces and an orifice extending through the body from the outward to the inward surface;

an assembly to secure the spacer around the rotor axially between sequential buckets of the forward and the aft stage, the spacer forming an annular passage around the rotor into which the cooled fluid flows through the orifice; and a circuit defined through a gun hole formed within a fir-tree section of the more forward one of the sequential buckets, the circuit being fluidly coupled to the annular passage to deliver the cooled fluid from between the sequential buckets of the forward and the aft stage to an axial location forward of the forward stage.

18. A steam turbine engine, comprising:

a rotor disposed within a casing to define a passage through which steam flows from a forward to an aft turbine stage at which the steam is relatively cooled;

a spacer having an annular body formed with opposing outward and inward surfaces and an orifice extending through the body from the outward to the inward surface;

an assembly to secure the spacer around the rotor axially between sequential buckets of the forward and the aft stage, the spacer forming an annular passage around the rotor into which the cooled steam flows through the orifice; and a circuit defined through a gun hole formed within a fir-tree section of the more forward one of the sequential buckets, the circuit being fluidly coupled to the annular passage to deliver the cooled steam from between the sequential buckets of the forward and the aft stage to an axial location forward of the forward stage.

* * * * *